United States Patent [19]

Green

[11] Patent Number: 4,720,263

[45] Date of Patent: Jan. 19, 1988

[54] TRANSPORTABLE SYSTEM FOR PROVIDING HEAT TO FLOWING MATERIALS

[76] Inventor: Robert S. Green, 12270 Jim Platt Rd., Citronell, Ala. 36522

[21] Appl. No.: 870,503

[22] Filed: Jun. 4, 1986

[51] Int. Cl.[4] ..... F24H 1/00

[52] U.S. Cl. ..... 432/222; 122/367 C; 122/367 R; 122/476

[58] Field of Search ..... 432/222; 122/33, 248, 122/367 R, 367 C

[56] References Cited

U.S. PATENT DOCUMENTS

| | | | |
|---|---|---|---|
| 2,096,285 | 10/1937 | Lord et al. | 257/229 |
| 2,607,337 | 8/1952 | Miller | 126/343.5 |
| 2,908,331 | 10/1959 | Brown | 166/61 |
| 2,911,047 | 11/1959 | Henderson | 166/61 |
| 3,060,905 | 10/1962 | Cunningham, Jr. et al. | 122/448 |
| 3,077,343 | 2/1963 | Mohn | 432/222 |
| 3,140,744 | 7/1964 | Bailly | 166/61 |
| 3,962,999 | 6/1976 | Rehm | 122/248 |
| 3,991,823 | 11/1976 | Litke et al. | 165/145 |
| 4,041,908 | 8/1977 | Rasinski | 122/479 R |
| 4,124,068 | 11/1978 | Thompson | 122/367 C |
| 4,268,248 | 5/1981 | Wilbur et al. | 432/222 |
| 4,299,194 | 11/1981 | Miller | 122/33 |
| 4,316,501 | 2/1982 | Bowden et al. | 165/70 |
| 4,321,963 | 3/1982 | Bowden | 165/70 |
| 4,357,910 | 11/1982 | Blockley et al. | 122/248 |
| 4,377,133 | 3/1983 | Mankekar | 122/367 C |
| 4,387,766 | 6/1983 | Miller | 165/172 |
| 4,412,510 | 11/1983 | Perry et al. | 122/476 |
| 4,453,498 | 6/1984 | Juhasz | 122/367 R |

*Primary Examiner*—Henry C. Yuen

[57] ABSTRACT

An apparatus for in-process removal of built-up paraffin and the like from the inner surface of oil pipelines and the like has a combustion section and a heat transfer section. The combustion section includes an air heater, a blower for causing air to flow through the heater and through a heat transfer section, and a conduit for recirculating air from the heat transfer section to the combustion section. The heat transfer section includes a heater shell, and, disposed therewithin, a heat transfer tubing coil connected in an oil pipeline, upstream of built-up material to be removed, oil in the pipeline, being caused to flow through the coil. Heated air from the combustion section flows across the coil in the heater shell in a manner for transfer of heat from the air to the coil and to the oil flowing therewithin, whereby the temperature of the oil in the coil is raised to a predetermined temperature to liquify material built-up on the inner surface of the pipeline and the like to flow with the oil.

7 Claims, 5 Drawing Figures

TRANSPORTABLE SYSTEM FOR PROVIDING HEAT TO FLOWING MATERIALS

The invention relates to equipment for treating fluid at a remote well site.

Crude oil pipelines, particularly those from isolated oil wells, and often the wells themselves, are subject to gradual buildup of paraffin and the like on the inner surfaces, which restricts the flow of oil. In order to maintain flow at profitable levels, the pipelines, and wells, must be cleaned periodically to remove this buildup. In the past, in order to clean, it has been necessary to stop flow from the well during the cleanup process, with resulting loss of production.

Also, new wells oftentimes develop problems with emulsions or foaming of the flow, due to drilling fluids still suspended in the flowing product.

The objectives of this invention include providing equipment for cleaning crude oil pipelines and wells; providing equipment that permits cleaning of the pipelines and wells in the field, including wells remote from the central production facility; and providing a system for cleaning the pipelines in-line, without significant loss of production time.

SUMMARY OF THE INVENTION

According to the invention, apparatus for in-process removal of built-up paraffin and the like from the inner surface of oil pipelines and the like comprises a combustion section and a heat transfer section, the combustion section comprising an air heater means, blower means for causing a predetermined volume of air to flow through the heater means to be heated and into the heat transfer section, and conduit means for recirculation of air from the heat transfer section to the combustion section, the heat transfer section comprising a heater shell, and, disposed therewithin, a heat transfer tubing coil adapted to be connected in an oil pipeline, upstream of built-up material to be removed, oil in the pipeline being caused to flow through the coil, and means for causing the heated air from the combustion section to flow across the coil in the heater shell in a manner for heat to be transferred from the air to the coil and to the oil flowing therewithin, whereby the temperature of the oil in the coil is raised to a predetermined temperature to liquify material built up on the inner surface of the pipeline and the like to flow with the oil.

In preferred embodiments, the apparatus is adapted for transportation to the site of an oil well, and further comprises self-contained energy packages; the air heater means is a short flame burner; the tubing coil further comprises fin means disposed about the exterior of the tubing and extending outwardly therefrom, preferably the fins are L-shape, and base portions of the fins are deep penetration welded to the tubing in a manner to improve heat transfer from the heated air to the crude oil; the heated air is caused to flow through the heat transfer section in true cross flow to the coil, and transfer of heat from the air to the oil is essentially by conduction and convection; the apparatus is constructed and arranged in a manner to cause the heated oil to flow into a well for removal of built-up parafin and the like; and the apparatus is adapted for connection in the pipeline of a new well in a manner to reduce emulsion and foaming in the pipeline.

There is thus provided a completely portable heating apparatus for in-process removal of buildup paraffin and the like from the inner surface of oil pipelines, separators, headers, tanks, etc.

These and other features and advantages of the invention will be understood from the following description of a presently preferred embodiment, and from the claims.

DESCRIPTION OF THE PREFERRED EMBODIMENT

We first briefly describe the drawings.

DRAWINGS

Figure 1:
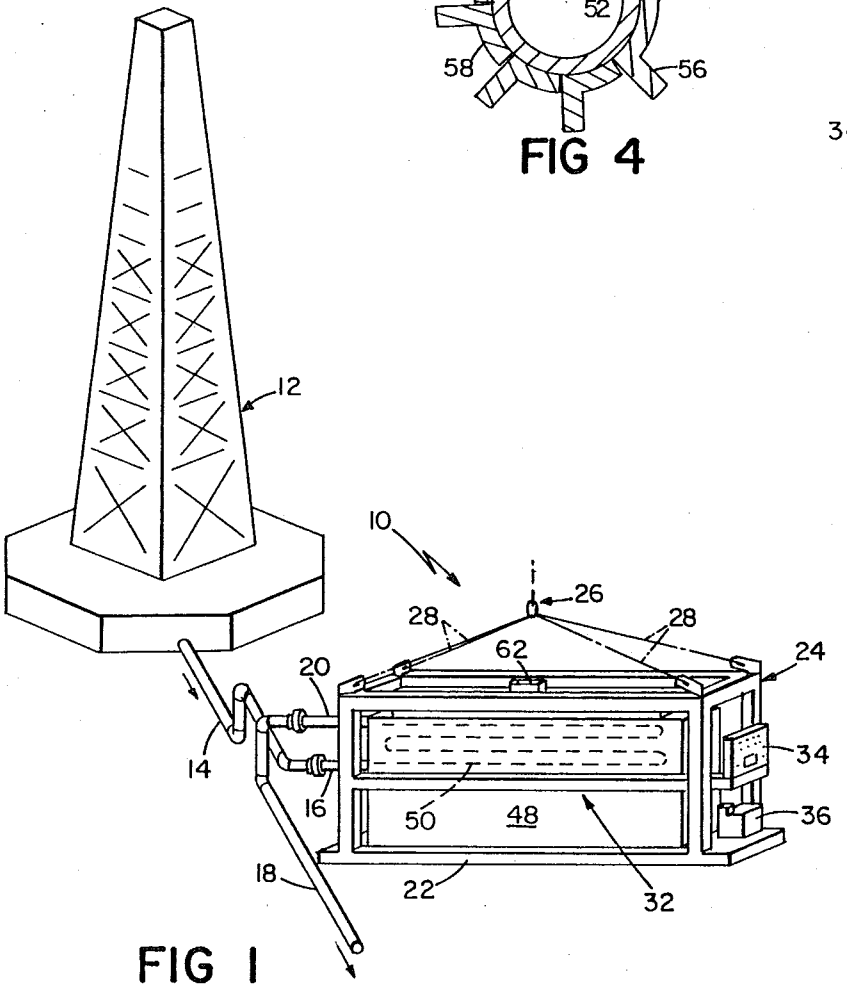
FIG. 1 is a perspective view of the crude oil pipeline cleaning system of the invention.

Referring to FIG. 1, the crude oil pipeline cleaning system 10 of the invention has been transported into the field and placed adjacent a working oil well 12. Pipeline 14 from the well is connected to inlet pipe 16, e.g., about 1½ inch diameter, of the cleaning system for delivery of oil from the well into the system. The continuation 18 of the pipeline to the central facility is connected to the system outlet pipe 20, to allow oil from the well to flow through the cleaning system, and on to the central facility essentially without interruption or loss of product flow.

Figure 2:
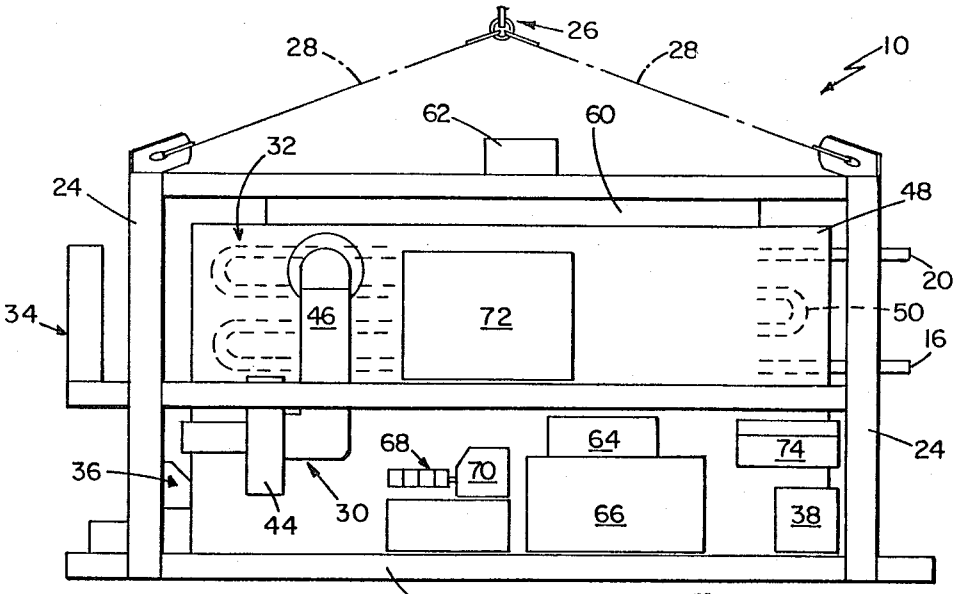
FIGS. 2 and 3 are side and end views of the system of the invention, respectively.
Figure 3:
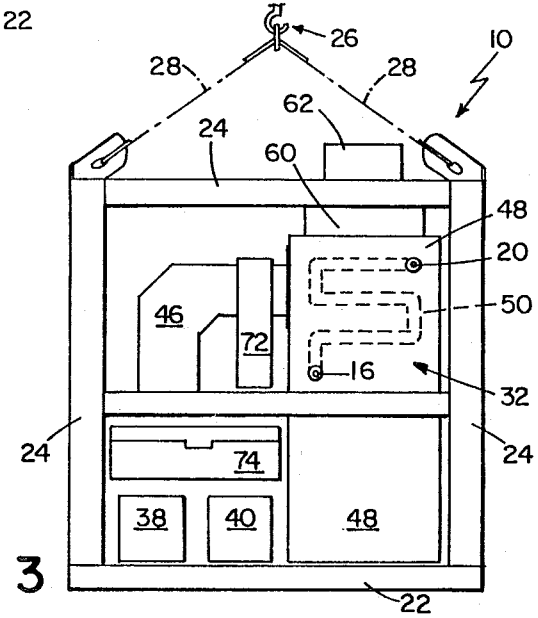
Figure 4:
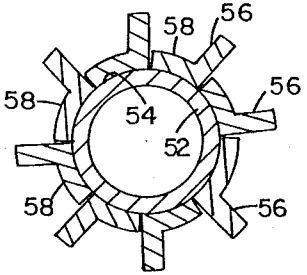
FIG. 4 is a cross section view of a heat transfer tube.

Referring now also to FIGS. 2 and 3, the system 10 of the invention is constructed on a reinforced frame 22, e.g. about 13 feet long by 6 feet wide and having a framed base section about 3 feet high and corner section about 8 feet high, supported by braces 24. The frame is of size and construction to permit the unit to be transported to the site of an isolated producing oil well 12. A single eye 26 attached to the corners of the frame by wire slings 28 allows the entire system to be lifted and moved into the desired position.

The components of the cleaning system disposed on the frame generally form a combustion section 30, a heat transfer section 32, and auxiliary services provided by self-contained energy packages. The system is operated from panel 34.

Combustion section 30 consists of a short flame burner 36, fueled by diesel from tank 78, being ignited by a pilot which uses butane from two five-gallon tanks 38, 40, which can be removed from the frame for replenishment. Air is fed by blower 44 across the burner and forced upwards through heat transfer section 32. Since recirculated air has no oxygen, a precombustion air fan 42 (seen only in FIG. 5) feeds air to the burner, and air duct 46 carries the cooled air from the heat transfer section 32 back to recirculating blower 44.

The heat transfer section 32 includes a heater shell 48 containing exchanger tube coil 50 of serpentine configuration, through which crude oil from the producing well, entering via inlet pipe 16, is caused to flow before exiting via outlet pipe 20. The tubing 52 of the coil 50 carries, on its outer surface 54, fins 56 of L-shape, having bases 58 which are affixed to the tubing 52 by deep penetration welding. As described more fully below, these fins serve to enhance the rate of heat transfer from the heated air flowing from the combustion section into the flowing crude oil and also protect the tubes for longer useful life. If it becomes necessary to repair or replace the tubing coil 50, it can be simply removed from the heater shell 48 by removing the top section 60 of the shell and lifting out the coil. The coil can be returned after repair, or a new or replacement coil installed immediately to keep the cleaning system in service with little downtime.

The excess heated air is exhausted from the heater shell via exhaust stack 62.

The auxiliary services provided on the portable frame 22 include an air compressor 64 and compressed air tank 66 for producing and storing compressed air and an hydraulic pump 68 driven by diesel engine 70, with a tank 72 for providing hydraulic oil storage, provide energy to run hydraulic motors on fans, the diesel pump, and air compressor at the remote site. A secure storage box 74 for tools and the like is also provided.

The cleaning system 10 is transported, e.g., on a flat bed truck or boat, to the site of a producing oil well 12, which may be remote from the central production facility. The system is unloaded and positioned adjacent the pipeline to be cleaned. (This may be accomplished by crane by engaging the eye 26 and lifting and carrying the entire system to the desired position.)

Oil production from the well is halted only briefly while production pipeline 14/18 is uncoupled and the pipe section 14 from the well connected to the inlet pipe 16 to the system, and the pipe section 18 to the production facility connected to the system outlet pipe 20. Oil production from the well 12 is resumed after only a brief interruption, and production continues, with the oil now flowing through the tubing coil 42.

Figure 5:
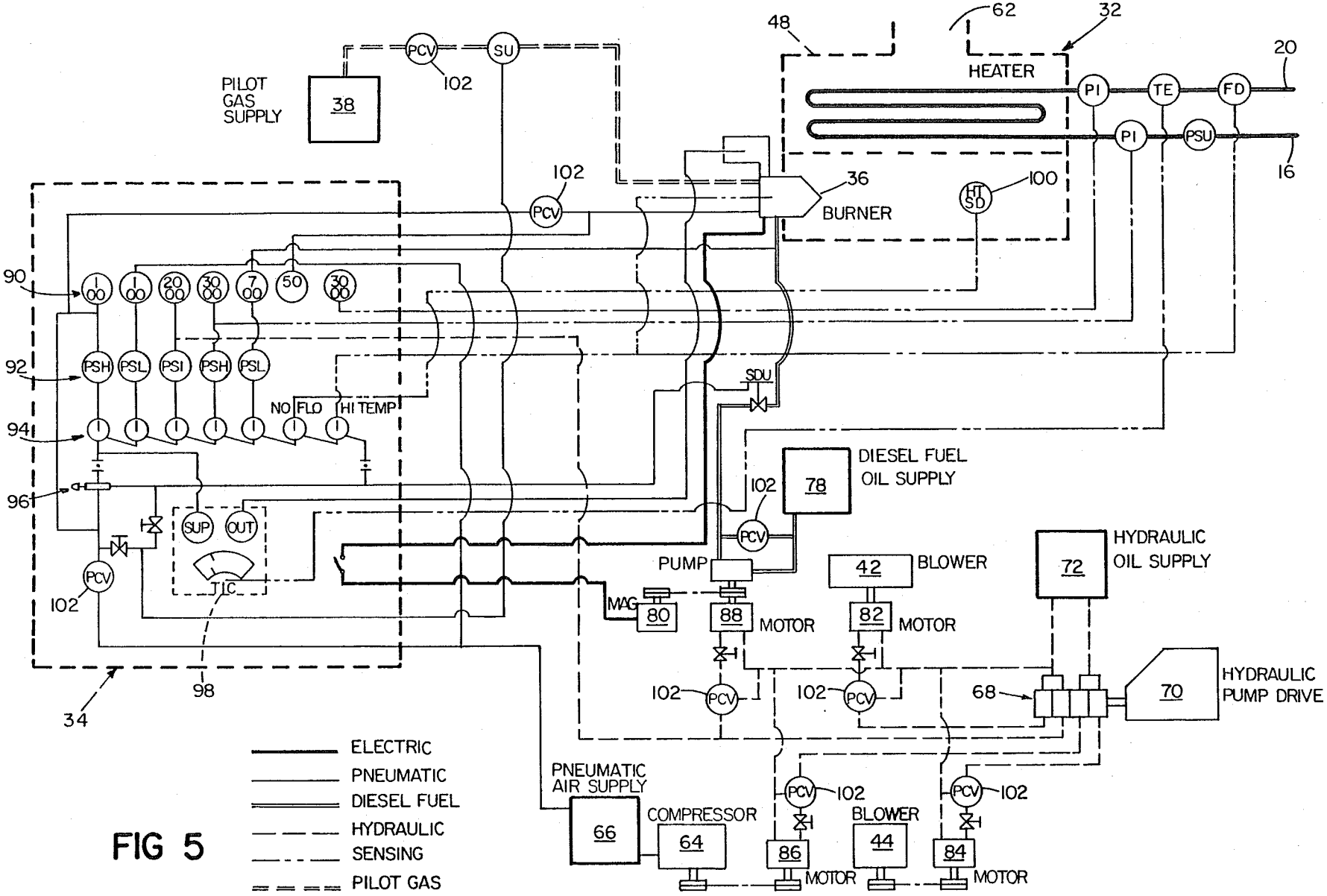
FIG. 5 is a schematic flow diagram of the safety and control system.

We now refer also to FIG. 5, a schematic flow diagram, which can be readily understood by one skilled in the art and thus is only briefly discussed. Engine 70, e.g., a diesel engine manufactured by Lister, powers the hydraulic pump 68. The hydraulic pump in turn powers the motors 82, 84 for blowers 42 and 44 and the motor 86 for air compressor 64. It also powers the fuel pump 88 which supplies diesel fuel to the burner and turns the magneto which provides the spark for igniting the butane pilot.

At panel 34, gauges 90 indicate the pressures of high and low air safety, hydraulic, flow, diesel fuel, fuel air and outlet. The control panel also includes high-low pilots 92 for each pressure measurement, indicators 94, a pneumatic safety switch 96 and a temperature indicator controller 98.

For safety, an automatic high temperature shutdown 100 is provided on the heater shell, and pressure control and relief valves 102 are provided in the various flow lines as indicated in FIG. 5.

Burner 36, fueled with diesel from tank 78 and fed air by blower 42, is ignited by butane pilot. Burner 36, a short flame burner selected to reduce the possibility of flame impingement in the tubing coil 50, is disposed at a position spaced from the coil to eliminate the necessity of having burners firing in the coil section through which the crude oil is flowing. The blowers supply a high volume flow of air, typically 100% of the theoretical combustion air requirement, through the burner. The air blowers are operated at constant flow volume, and since the excess air is 66% of the total flow through the combustion section, heater start-up is made simpler. Also, the high mass flow rate of air carried by blower 44 through the heat transfer section, as described below, results in less buildup of internal cabin temperatures within heater shell 48.

The air, heated to a maximum of about 800° F. by the burner, and circulated by the blowers through the combustion section, flows through the heat transfer section in true cross flow across the finned heat transfer section coil, and returns via duct 46 to be reheated. The system thus avoids heat transfer by radiation, and the non-uniformity typically found in radiant-type heaters is eliminated.

Heat from the air is transferred into the crude oil, further facilitated by fins 56 on the tubing coil surface, to raise the temperature of the flowing crude to above a predetermined minimum temperature necessary to cause the built-up wax to liquify and flow with the crude oil to the central production facility.

The external fins 56 on the tubing receiving heat from the flue gas are of material having greater thermal conductivity than the inside film coefficient; thus heat is transferred uniformly around the fins themselves and to the inside of the pipe at a uniform rate since both of these coefficients are significantly higher than the outside coefficient. Further, as mentioned above, the fins are L-shaped strips, with the bottom leg 58 of the "L" welded to the tube by a full penetration continuous weld. This provides additional surface area to the face of the tube to protect it from direct flue gas impingement, and makes the resultant transfer of essentially convective/conductive nature.

The design of the heat transfer section results in the inside heat transfer coefficient (tube to oil) being much higher than the outside (flue gas to fin), which allows the heat to be removed from the tube wall by the process fluid faster than the flue gas can supply it. This results in lower and more uniform tube wall temperatures and consequently lower fluid film temperatures. In this manner, constant heat transfer is achieved with the net result that the gas temperature is constantly decreasing as it travels through the convector, for thermal efficiencies of 90% or better.

The stack gas exits the heater shell at approximately 280° F., well below the auto ignititon temperature of natural gas (1000° F.).

Other embodiments are within the following claims. For example, a secondary combustion chamber may also be employed, where the products of combustion from the primary burner are mixed with air from the lower pressure recirculation air fan over eight feet of horizontal travel so that the flue gases are completely mixed upon entry into the coil section. Also, referring generally to FIG. 1, the inlet 16 to the system may be connected to a crude oil storage tank and the outlet 20 connected to a pipe to the oil well in order to deliver heated oil from the cleaning system of the invention into the well to melt and remove buildup in the well that may be restricting flow of production. The cleaning system of the invention may also be used, where desired, in a configuration as shown in FIG. 1, at new wells to quickly reduce the level of emulsions and foaming of the flow, in order to more rapidly bring production of a salable product.

What is claimed is:

1. An apparatus for connection in-line to a pipeline of a producing pretroleum product well and the like for heating the petroleum product flowing in the pipeline for in-process removal of built-up parafin and the like from the inner surface of the pipeline, said apparatus comprising:

a combustion section and heat transfer section, said combustion section comprising an air heater means, blower means for causing a predetermined volume of air to flow through said heater means to be heated and into the heat transfer section, and conduit means for recirculation of air from said heat transfer section to said combustion section, said heat transfer section comprising a heater shell, and, disposed therewithin, a heat transfer tubing coil adapted to be connected in a pipeline of a producing petroleum product well, upstream of built-up material to be removed, for receiving the flow of petroleumm product in said pipeline from said well, product in said pipeline being caused to flow through said coil, and means for causing the heated air from said combustion section to flow across the coil in said heater shell for transfer of heat from said air through said coil to the product flowing therewithin, said tubing coil further comprising fin means disposed about the exterior of said tubing and extending outwardly therefrom for relatively greater surface area about the exterior of said tubing coil, said fin means and said tubing coil being formed of material having greater thermal conductivity than the petroleum product film coefficient within said pipeline and said fins means and said tubing coil being joined in a manner whereby heat is transferred uniformly about said fin means and tubing coil, and the rate of heat transfer from said coil to said petroluem product is greater than the rate of heat transfer from the heated air into said fin means, whereby the temperature of the product in said coil is raised to a predetermined temperature to liquify material built up on the inner surface of said pipeline to flow with said petroleum product.

2. The apparatus of claim 1 wherein said apparatus is adapted to transportation to the site of an oil well, and further comprises one or more self-contained energy packages.

3. The apparatus of claim 1 wherein said air heater means is a short flame burner.

4. The apparatus of claim 1 wherein said fin means are L-shape, and are disposed about the exterior of said tubing by deep penetration welding.

5. The apparatus of claim 1 constructed and arranged to cause said heated air to flow through said heat transfer section in true cross flow to said coil, and heat transfer from said air to said petroleum product uniform and being essentially by conduction and convection.

6. The apparatus or claim 1 adapted for connection to an external source of petroelum, and further comprising means for delivery of a flow of heated petroelum product from an external source into a well for liquification for removal of built-up parafin and the like therewithin.

7. The apparatus of claim 1 adapted for connection in the product pipeline of a new well for reducing emulsion and foaming of petroleum product in said pipeline.

* * * * *

UNITED STATES PATENT AND TRADEMARK OFFICE

CERTIFICATE OF CORRECTION

PATENT NO. : 4,720,263

DATED : Jan. 19, 1988

INVENTOR(S) : Robert S. Green

It is certified that error appears in the above-identified patent and that said Letters Patent are hereby corrected as shown below:

Column 6, line 9, "adapted to" to --adapted for--.

Column 6, line 22, "or" to --of--

Signed and Sealed this

Sixteenth Day of August, 1988

*Attest:*

*Attesting Officer*

DONALD J. QUIGG

*Commissioner of Patents and Trademarks*